United States Patent [19]

Benedetti

[11] Patent Number: 4,905,493

[45] Date of Patent: Mar. 6, 1990

[54] ROLLING STAND WHICH CAN BE CONVERTED INTO A FOUR-HIGH STAND OR UNIVERSAL STAND, AND ROLLING LINE WHICH EMPLOYS SUCH CONVERTIBLE STAND

[75] Inventor: Giampietro Benedetti, Campoformido, Italy

[73] Assignee: Danieli & C. Officine Meccaniche S.p.A., Buttrio, Italy

[21] Appl. No.: 218,150

[22] Filed: Jul. 13, 1988

[30] Foreign Application Priority Data

Aug. 4, 1987 [IT] Italy ..... 60418/87[U]

[51] Int. Cl.[4] ..... B21B 13/10; B21B 31/04

[52] U.S. Cl. ..... 72/225; 72/238; 72/239

[58] Field of Search ..... 72/225, 237, 238, 239, 72/226, 249

[56] References Cited

U.S. PATENT DOCUMENTS

| | | | |
|---|---|---|---|
| 3,908,426 | 9/1975 | Aramaki | 72/238 |
| 3,949,586 | 4/1976 | Neumann | 72/238 |
| 4,222,258 | 9/1980 | Field | 72/239 |
| 4,557,130 | 12/1985 | Bond | 72/238 X |

*Primary Examiner*—W. Donald Bray

*Attorney, Agent, or Firm*—Wegner & Bretschneider

[57] ABSTRACT

Rolling stand which can be converted into a four-high stand or universal stand, comprising two coordinated pairs of roll standards (13) mounted on a base plate (11), said roll standards being able to support a universal stand roll assembly (24) or a four-high stand roll assembly (25), said roll standards being longitudinally movable and able to be reciprocally positioned at least in their working position on said base plate (11), each pair of roll standards permanently bearing two main standardized housings (14) together with their associated devices (15) for adjusting the distance between the centers of the rolls, said devices (15) cooperating with supports (16) comprised in said roll standards (13), said main housings (14) supporting horizontal axis rolls (35), either the vertical axis rolls (28) belonging to an universal stand roll assembly (24) or the horizontal axis rolls (36) of a four-high roll assembly (25) being located within the interspace comprised between two main housings (14) of each pair of roll standards (13).

Rolling line which comprises a plurality of stand bodies (10) with end frames (34), on which (34) are installed assemblies (24) for conversion of the stands into universal stands able to roll I-beams, H-beams and like sections.

13 Claims, 4 Drawing Sheets

ROLLING STAND WHICH CAN BE CONVERTED INTO A FOUR-HIGH STAND OR UNIVERSAL STAND, AND ROLLING LINE WHICH EMPLOYS SUCH CONVERTIBLE STAND

This invention concerns a rolling stand which can be converted, if so required, into a four-high stand or a universal stand.

To be more exact, the invention concerns a stand which employs standardized roll standards suitable for the positioning and anchorage of the specific rolls of four-high stands or of universal stands, and also concerns a rolling line which employs such rolling stand which can be converted into a four-high stand or a universal stand.

BACKGROUND OF THE INVENTION

At the present time four-high stands have been designed, structured and made to process only wide flat products and cannot be employed, when so required, as universal stands too.

Likewise, universal stands have been designed, structured and made to process sections, such as I-beams and sections with a normal or wide flange or other sections such has H-beams, but cannot be suitable to process wide flat products and therefore to perform the functions of a universal stand.

The need to have not two separate rolling lines but to be abel to have in the same line and with the same stands both four-high stands and universal stands and vice versa has been felt for some time now.

This need is mainly felt on economical grounds and is linked firstly to the processing of small lots, where the need to obtain swift changes of the product to be manufactured has become urgent, and secondly to the instability of the market with its high and low points of demand, now for one type of product and now for another type.

Each of these plants involves requirements of investment, space occupied and embodiment of plants, and it is unthinkable that two specialized plants should be set up, one for one type of product and the other for another type of product, and should then be underemployed and used only part-time.

On the other hand, considerable technical problems are involved in embodying a rolling stand which can process both wide flat products and also I-beam sections or the like.

It is enough to think of the substantial differences in the rolling rolls and in their composition so as to understand the technical, technological and conceptual problems which hinder such an embodiment.

Documents FR-A- No. 2.541.600, JP-A- No. 54139866, DE-A- No. 1,937,368, U.S. Pat. No. 3,319,450 and EP-A- No. 0,166,478 refer to rolling stands which can be converted from universal stand into two-high stand and vice-versa.

None of said documents provides for the possibility of converting an universal stand into a four-high stand.

Furthermore, the rolling stands disclosed in said documents are of relatively complicated use, owing to the plurality of elements which they comprise; the substitution of the rolls is always a slow and difficult operation.

Document JP-A- No. 62114706 discloses a rolling stand which can be converted from an universal stand into a two-high and/or a four-high stand and vice-versa, according to the preamble of claim 1.

This kind of stand is provided with fixed roll standards forming, by pairs, a frame into which the different rolls are laterally inserted.

Said rolls are inserted in the spaces comprised between the standards by means of a laterally movable carriage, causing a remarkably large lateral bulk of the whole roll stand.

Furthermore, all the rolls must necessarily be provided of their housings and of the elements for journaling them to the standards, prior to the insertion into the standards.

Owing to the fixed spatial disposition of the roll standards, only rolls having particular dimensions may be used, and in the case of a stand converted into a four-high stand, the wide flat strips which are produced may obviously not have a width which goes beyond the distance between the roll standards.

SUMMARY OF THE INVENTION

It is a purpose of the present invention to obviate such difficulties and to enable one and the same rolling line to perform the rolling of wide flat products and of I-beams, H-beams, H-beams with a wide flange, etc.

This is obtained by a convertible rolling stand of the kind mentioned above, and having the features disclosed in the characterising part of claim 1.

The dependent claims illustrate advantageous forms of embodiment of the invention.

According to the invention a stand body comprises four roll standards which can be positioned either in their working position or in a position for conversion and which cooperate in a stable manner with the main housings and relative tie rods. The lengthwise positioning of the roll standards can be carried out by hand or automatically.

Such roll standards with their relative main housings cooperate with the rolls and with the accessory housings suited to the purpose.

The main housings have standardized overall dimensions for cooperation with their respective rolls, and the intermediate distances too are standardized.

Additional accessories such as fixture plates, reinforcing bars, stiffening bars, etc. may be comprised so as to make possible the maximum usage of the stands according to the invention as momentarily equipped according to the examples in the figures.

According to the invention the rolls which cooperate with the main housings have the same dimensions in relation to their seatings.

Processing rolls for four-high stands, or rolling rings with a vertical axis for universal stands, may be fitted in an intermediate position in cooperation with the housings and rolls.

The invention is therefore embodied with a stand body able to bear rolls for a four-high stand or rolls for a universal stand.

BRIEF DESCRIPTION OF THE DRAWINGS

The attached figures, which are given as a non-restrictive example, show the following.

DESCRIPTION OF THE PREFERRED EMBODIMENT

Figure 1:
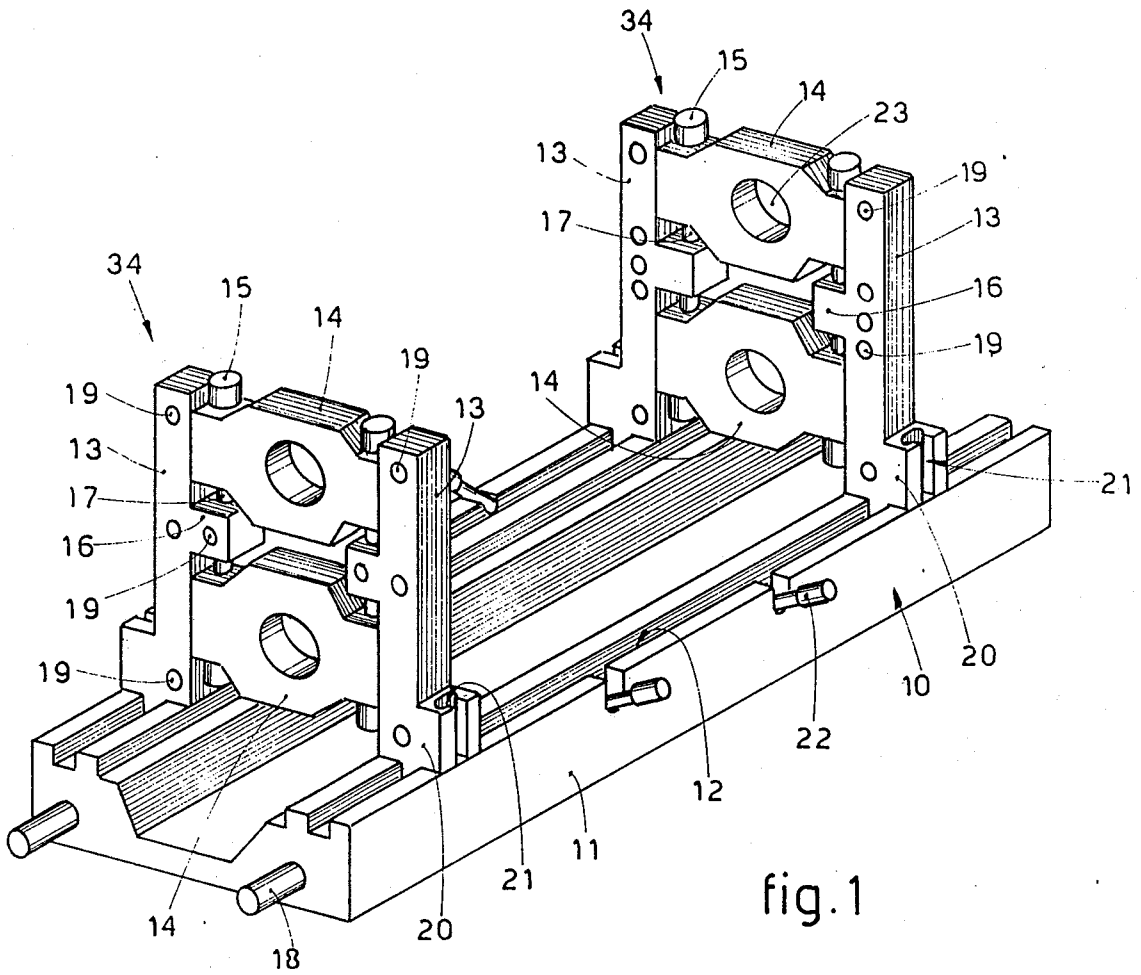
FIG. 1 gives a three-dimensional view of a stand body according to the invention.

The various components are shown diagrammatically in the figures so as to clarify the concept of embodiment according to the invention as much as possible.

According to the invention a standardized stand body 10 comprises mainly a base plate 11 with lengthwise guides 12, roll standards 13 and main housings 14 with relative devices 15 to adjust the distance between centres of rolls.

The roll standards 13 are coupled together two by two and can move lengthwise along the base plate 11 in the guides 12.

The roll standards 13 comprise supports 16 that cooperate with main screws 17 of the adjustment devices 15.

Lengthwise displacement of the roll standards 13 can be carried out by hand or may be actuated by a motor 18.

An assembly of two roll standards 13, two main housings 14 and of the adjustment devices 15 for the distance between centres of the rolls constitutes an end frame 34.

The roll standards 13 comprise advantageously a plurality of holes 19 for fixture of the components and accessories needed for correct employment of the stands according to their specific purposes.

The roll standards 13 comprise seatings 21 at their lower end 20 for stationary or movable anchorage bolts 22 comprised in the base plate 11.

According to the invention the seatings 23 of the rolls in the main housings are standardized, as also are the other overall dimensions.

An assembly 24 for conversion into a universal stand and an assembly 25 for conversion into a four-high stand cooperate respectively with the end frames 34, which, as we said, can move lengthwise along the base plate 11.

By using the conversion assemblies 24–25 it is possible to provide specific, differentiated usages for the resulting stands.

The assembly 24 for conversion to a universal stand comprises essentially two horizontal rolling rings 26 and two vertical rolling rings 28, the vertical rings 28 being fitted to auxiliary housings 27 and suitable to roll the flange of a section.

The auxiliary housings 27 are positioned correctly between the main housings 14 and between the supports 16.

The assembly 25 for conversion to a four-high stand comprises pressure rolls 35 cooperating with the main housings 14 integrally fixed to the stand body 10 and also processing rolls 36 cooperating with specific housings 37.

The specific housings 37 are positioned correctly between the main housings 14 and between the supports 16.

The specific housings 37 of the processing rolls 36 comprise fixture lugs 29 which cooperate with retention plates 30–31.

The method of conversion of a rolling mill of one type into a rolling mill of another type according to the invention is simple.

With the rolling train pre-arranged with the relative stand bodies 10 preferably positioned reciprocally, the end frames 34 of each stand body 10 are positioned spaced apart lengthwise along the stand body 10, the end frames 34 being equipped in a stable manner with the main housings 14, as we said earlier.

If it is desired to equip the rolling train with a four-high stand, the various components of the assembly 25 for conversion to a four-high stand are positioned and the end frames 34 are brought towards each other and positioned.

If it is desired to convert the four-high stand thus obtained into a universal stand, the end frames 34 are distanced further from each other, the rolls 35–36 and specific housings 37 are removed, and in their place are positioned the horizontal rolling rings 26 and vertical rolling rings 28 with the relative auxiliary housing 27; a stiffening bar may be included.

In any event, bars 33 to stiffen the end frames 34 may be comprised.

Figure 2:
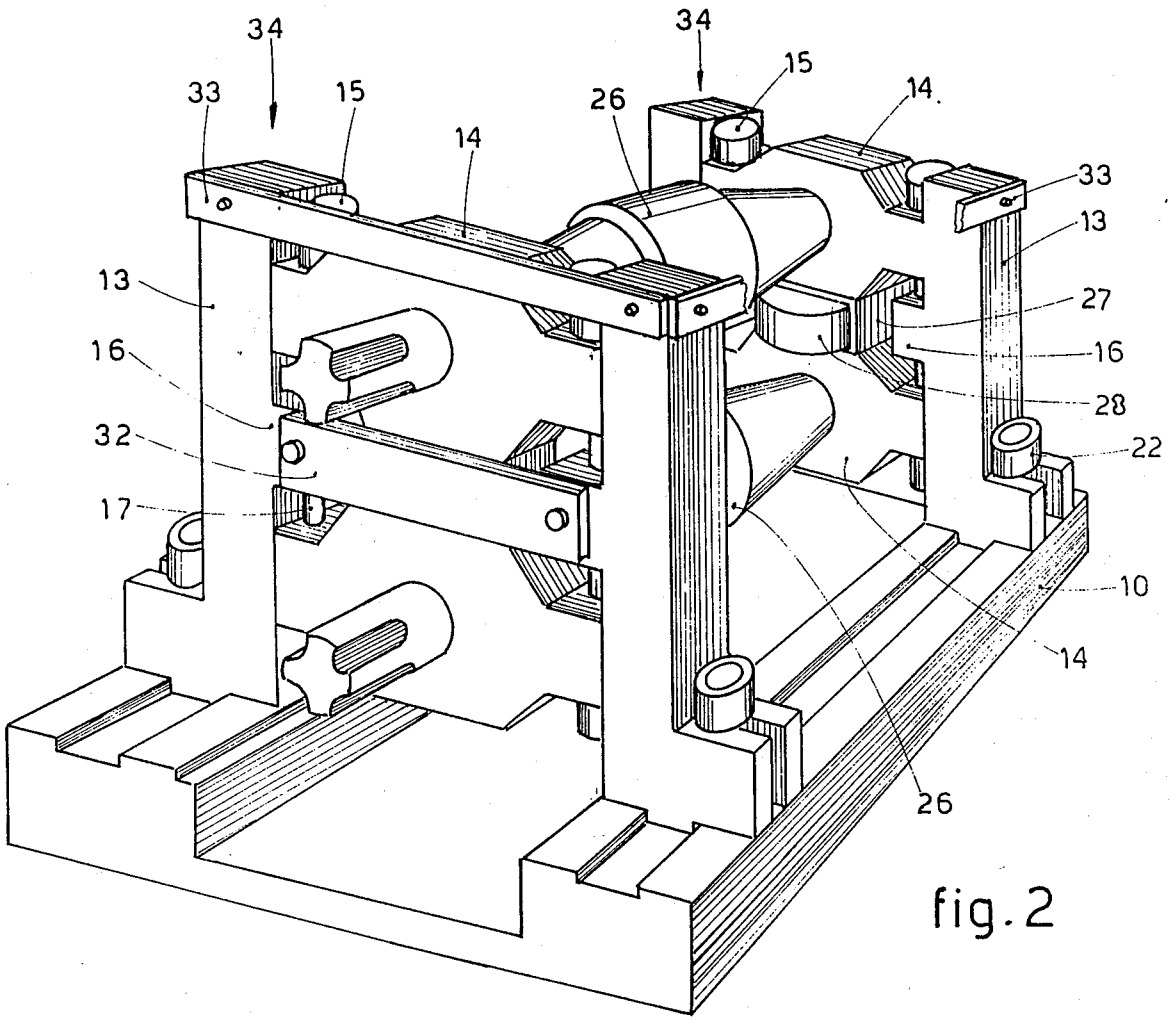
FIG. 2 show a stand for a universal rolling stand.
Figure 3:
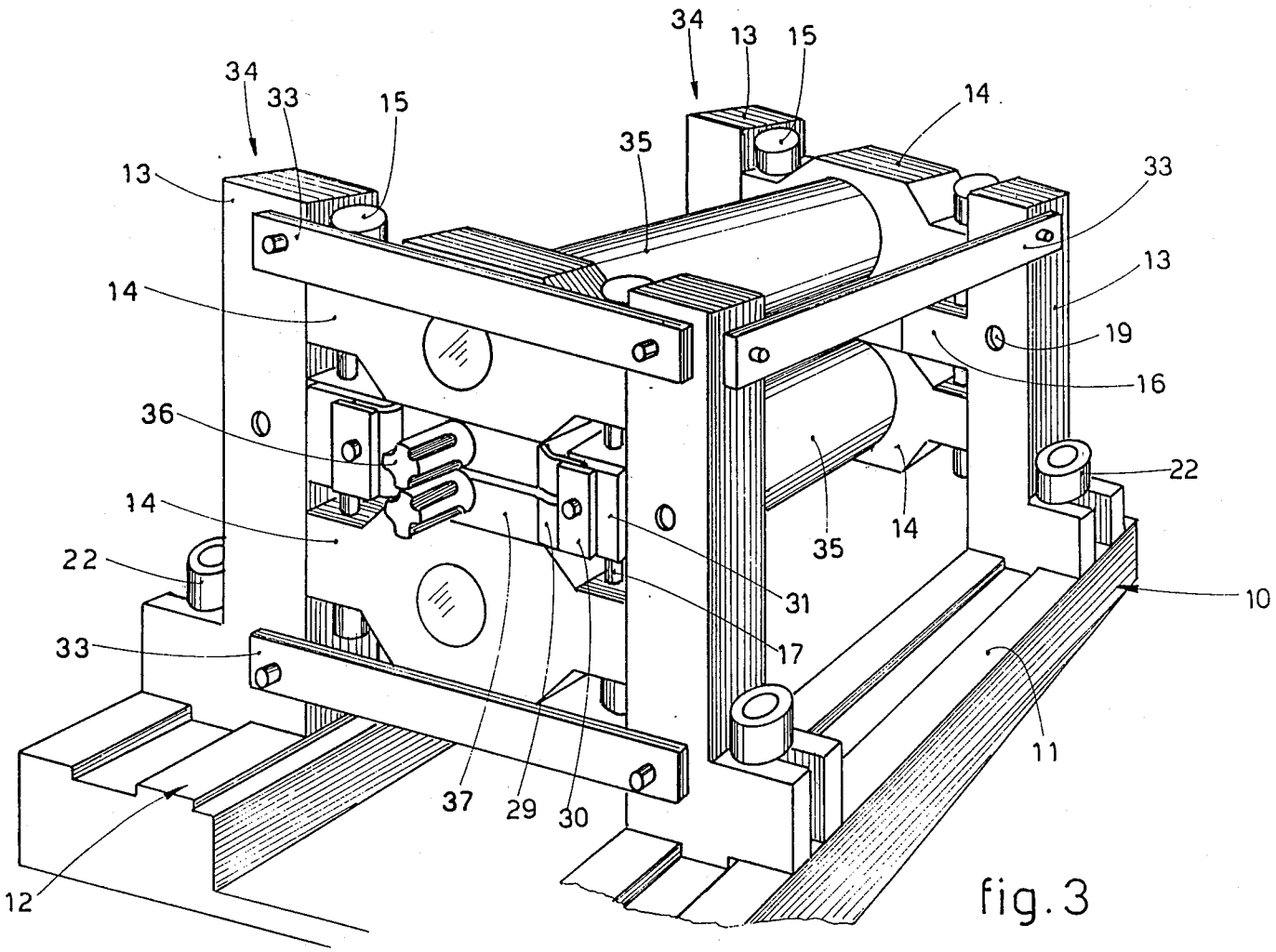
FIG. 3 gives a three-dimensional view of a stand for a four-high rolling stand.
Figure 4:
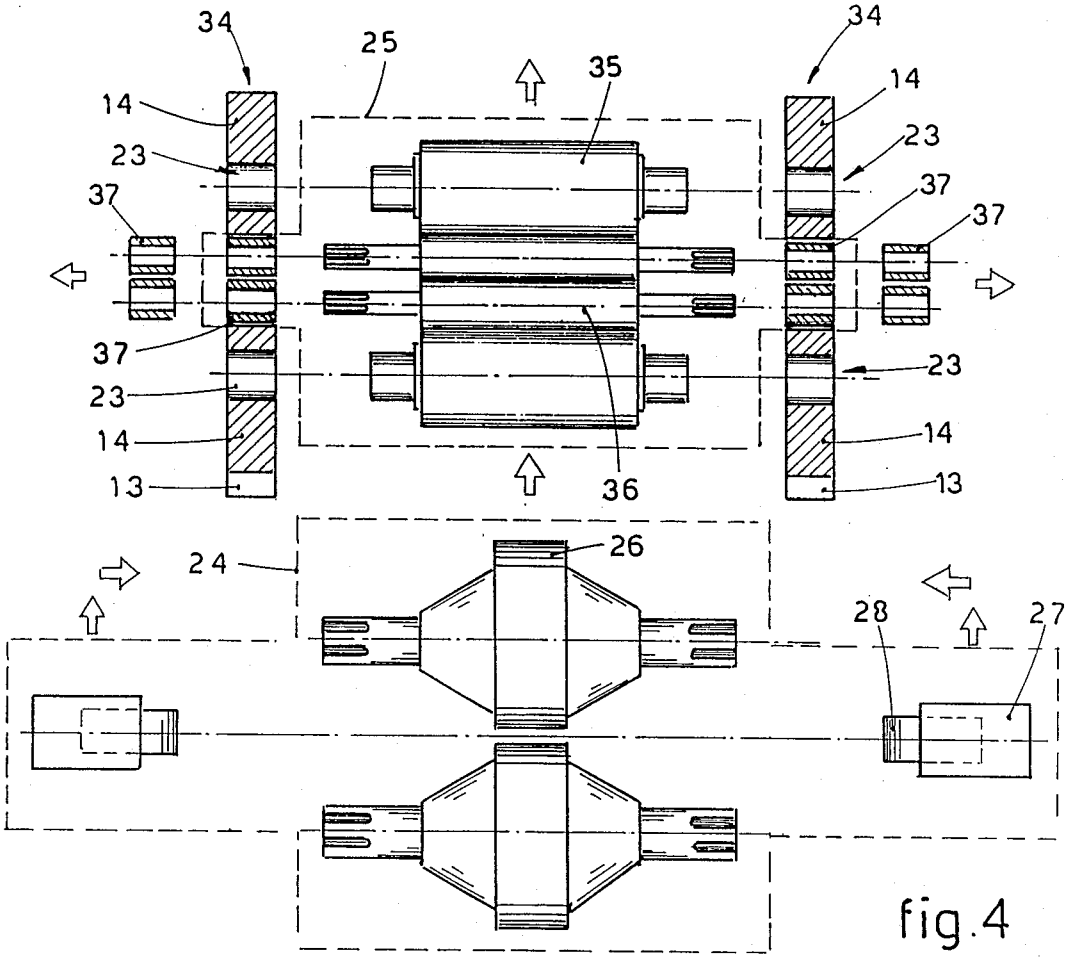
FIG. 4 gives a breakaway view of the basic components required to convert a stand equipped for four-high rolling into a universal stand according to the invention.

Thus the replacement times are very short and the ability to work either as a four-high stand (FIG. 3) or as a universal stand (FIG. 2) in the same rolling line is quite feasible.

We claim:

1. A rolling stand adapted to be converted into a four-high stand or universal stand, comprising:

a base plate;

two pairs of laterally spaced apart roll standards mounted on said base plate for supporting a roll assembly, wherein said pairs of laterally spaced apart roll standards are individually movable longitudinally on said base plate, and wherein said base plate has a longitudinal guide means for guiding longitudinal movement of said pairs of roll standards; and a plurality of vertically adjustable main housings for rotatably supporting a plurality of horizontal axis rolls;

wherein each of said roll standards has an inwardly projecting support means for supporting said main housings, a pair of said main housings being removably mounted between each pair of laterally spaced apart roll standards and being supported by said inwardly projecting support means.

2. A rolling stand as claimed in claim 1, wherein said main housings are provided with adjustment means for adjusting positional relationship between said main housings and said roll standards.

3. A rolling stand as claimed in claim 1, wherein said roll standards are provided with reinforcing means removably mounted thereto and extending therebetween for reinforcing said roll standards.

4. A rolling stand as claimed in claim 3, wherein said reinforcing means comprises a plurality of reinforcing elements extending horizontally between and connecting adjacent roll standards.

5. A rolling stand as claimed in claim 1, wherein each said roll standard has a base portion, and wherein a fixing means is provided for preventing movement of said base portion in relation to said base plate.

6. A rolling stand as claimed in claim 5, wherein said fixing means comprises at least one anchoring bolt for anchoring said base portion to said base plate.

7. A rolling stand as claimed in claim 1, wherein each said roll standard has a base portion, wherein said longitudinal guide means comprises a plurality of parallel longitudinal tracks, and wherein said base portion is provided with a cooperation means for cooperating with at least one of said plurality of longitudinal tracks.

8. A rolling stand as claimed in claim 1, further comprising housing means for rotatably supporting at least one additional roll, said housing means being removably mounted to each said pair of roll standards and being supported by said inwardly projecting support means.

9. A rolling stand as claimed in claim 8, wherein said housing means comprises a pair of first specific housings for rotatably supporting a vertical axis roll.

10. A rolling stand as claimed in claim 9, wherein said rolling stand is a universal stand.

11. A rolling stand as claimed in claim 8, wherein said housing means comprises a pair of second specific housings and a pair of horizontal axis rollers each having two ends, said pair of second specific housings rotatably supporting one said end of each of said pair of horizontal axis rollers.

12. A rolling stand as claimed in claim 11, wherein the rolling stand is a four-high stand.

13. A rolling stand as claimed in claim 8, wherein the rolling stand includes means for converting the stand between a universal stand and a four-high stand.

* * * * *